US005987715A

United States Patent [19]

Khon

[11] Patent Number: 5,987,715

[45] Date of Patent: Nov. 23, 1999

[54] MAGNETIC CLOSURE FOR A PERSONAL EFFECT CARRIER

[76] Inventor: Trinh Cam Khon, 1739 Aprilsong Ct., San Jose, Calif. 95131

[21] Appl. No.: 09/060,742

[22] Filed: Apr. 15, 1998

[51] Int. Cl.[6] ..... A44B 21/00

[52] U.S. Cl. ..... 24/303; 24/66.1; 292/251.5

[58] Field of Search ..... 24/303, 66.1; 292/251.5; 70/459; 248/309.4

[56] References Cited

U.S. PATENT DOCUMENTS

| | | | |
|---|---|---|---|
| D. 247,467 | 3/1978 | Morita | D8/331 |
| D. 247,468 | 3/1978 | Morita | D8/331 |
| D. 274,883 | 7/1984 | Aoki | D8/331 |
| 2,453,021 | 11/1948 | Konelsky | 292/251.5 |
| 3,378,893 | 4/1968 | Labek | 24/303 |
| 4,021,891 | 5/1977 | Morita | 24/303 |
| 4,033,013 | 7/1977 | Peterson | 24/201 |
| 4,265,002 | 5/1981 | Hosken | 24/303 |
| 4,480,361 | 11/1984 | Morita | 24/303 |
| 4,825,526 | 5/1989 | Shenier et al. | 24/303 |
| 4,882,815 | 11/1989 | Nilsen | 24/303 |

*Primary Examiner*—Victor N. Sakran
*Attorney, Agent, or Firm*—Jeffrey P. Aiello; Carol D. Titus; James J. Leary

[57] ABSTRACT

A magnetic closure device for personal effect carriers such as purses, pouches, day packs, and backpacks is provided. The invented closure device comprises a flap assembly affixed to a flap of the carrier and a receiving assembly affixed to the sidewall of the carrier. The receiving assembly is configured similar to the flap assembly, so that the receiving assembly mates with the flap assembly. The receiving assembly is provided with a projecting member configured to extend through the opening in the flap assembly, without projecting substantially beyond a cover plate thereof. The projecting member and opening coact as a guide to enable a user to locate the receiving assembly for quickly interconnecting the two assemblies. A magnet is retained in the receiving assembly for positively securing the flap assembly to the receiving assembly, to inhibit the device from inadvertently releasing. Components of the receiving and flap assemblies are configured to prevent the magnetic field radiated by the magnet from coming into the interior of the carrier and damaging articles stowed therein.

8 Claims, 4 Drawing Sheets

FIG. 3A
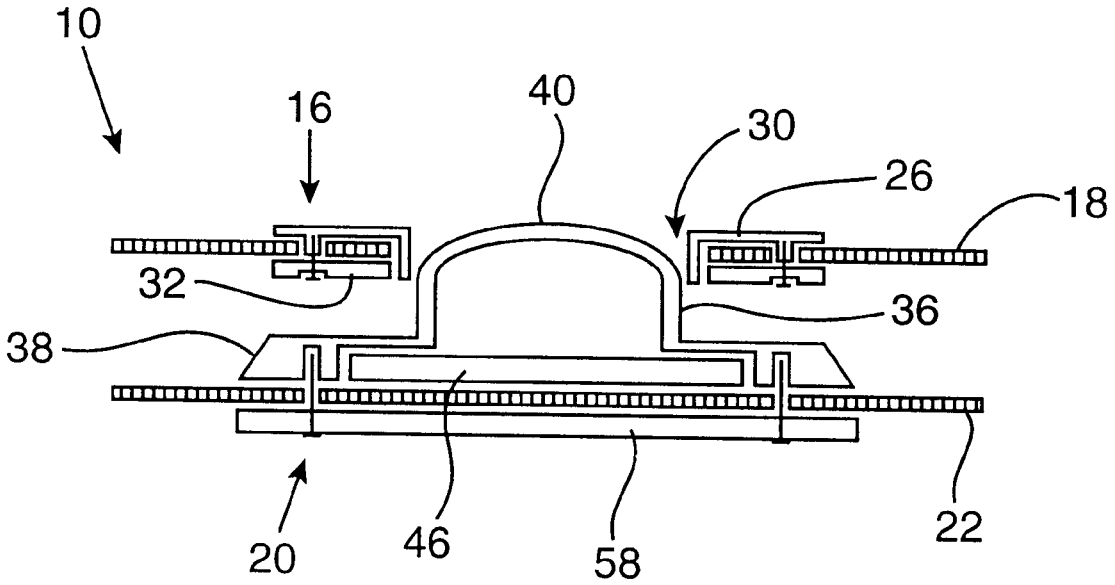
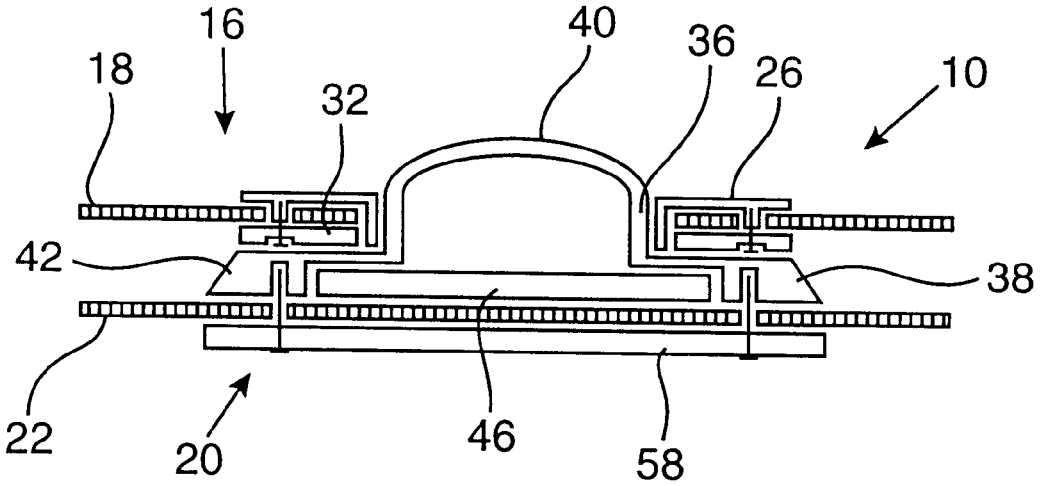
FIG. 3B

MAGNETIC CLOSURE FOR A PERSONAL EFFECT CARRIER

BACKGROUND OF THE INVENTION

1. Field of the Invention

The present invention relates generally to closure devices for purses, pouches and backpacks, and other personal effect carriers and more particularly, to an improved magnetic closure device for flexible personal effect carriers such as purses, pouches, and day packs and backpacks among others.

2. Description of Related Art

There are a number of closure devices in the prior art provided for flexible personal effect carriers including purses, day packs and backpacks, and hard-sided personal effect carriers such as briefcases, for example. These closure devices are configured for securing a number of different compartments in personal effect carriers. For example, purses and backpacks are often configured with a substantially large, flexible lid or flap, that extends over an opening of one or more compartments in the carrier and over a portion of the outer surface of the carrier adjacent to the compartment to completely cover the opening and enclose the compartment. These carriers are usually configured with a closure device that typically comprises two interlocking portions, with a first portion secured to the outer surface of the carrier that is covered when the flap is in a closed position, and a second potion that is configured to be received by the first portion. The user can interlock the two portions when the flap is brought against the outer surface of the carrier so that the closure device secures the flap against the outer surface of the purse for maintaining the opening to the compartment closed.

These closure devices may comprise any one of several well known configurations including turn-locks and turnbuckles, clamps, buckles, and snap fasteners among others. Often, such as in the case of purses for example, a receiving portion of the device comprises an opening in the flap that is configured to receive a projecting member of an interlocking portion affixed to the outer surface of the purse. The projecting member is placed through the opening and is adjusted so that the two portions interlock.

An alternative closure device configuration further utilizes magnetic means for interlocking the portions of the closure device to positively secure the flap to the outer surface of the carrier, for enclosing the desired compartment. In these prior art magnetic closure devices, a receiving portion of the device may comprise a portion of a magnetically attracted metal having a desired configuration that is affixed to an exterior of a flap covering an opening to a compartment of the carrier. An interlocking portion of the device is affixed to the outer surface of the carrier as previously discussed. The interlocking portion is configured with a mating region formed complementary to the magnetically attracted metal of the receiving portion, such as a protruding member or recess, to aid with interlocking the two portions of the device. A magnet may be located in or adjacent to the mating region, so that the magnet exerts magnetic force on the magnetically attracted metal of the receiving portion, for causing the two portions of the closure device to interlock.

However, a disadvantage of these prior art magnetic closure devices, is that it is substantially difficult for the user to align the receiving and interlocking portions of the closure device when bringing the flap against the outer surface of the carrier to close the opening. Since both portions are usually obscured from the user's view, it is difficult for the user to align the metal portion with the mating region, so that the magnet exerts sufficient force on the metal portion when rotating the flap toward the exterior of the opening, to cause the two portions to interlock. Frequently, the user must gaze directly at the outer surface of the carrier, or beneath the flap, to align the interlocking portions. Alternatively, the user may spend several seconds moving the flap about on the exterior of the purse until they feel the interlocking portions contact each other and are able to interlock the portions for closing the opening to the compartment. These actions by the user may cause objects stowed in the compartment, such as the user's personal belongings, to be dislodged from the carrier.

Another disadvantage of these prior art magnetic closure devices, is that the receiving and interlocking portions are not provided with any means other than the magnet to interlock. Thus, if the magnet is not sufficiently strong or if the user fails to properly align the metal portion with the magnet, the device may not interlock and the compartment would not be secured. Additionally, since the magnet is usually located on the outer surface of the sidewall of the carrier, the magnet is proximal to objects stowed in the carrier. Thus, if objects stowed in the carrier which may be damaged by the magnetic field radiated by the magnet, such as credit cards and magnetic data storage media, the magnetic field radiated by the magnet may cause information stored on these objects to be destroyed.

There are a number of closure devices for purses and the like disclosed in the prior art. For example, U.S. Pat. No. 4,033,013, to Peterson, discloses a closure for a flexible case, such as a brief case, purse or the like. The disclosed closure includes opposing flexible magnetic plastic strips that border an opening of the case. The magnetic strips are arranged to be of opposite polarity to develop an attraction force therebetween.

Another closure is disclosed in U.S. Pat. No. 4,420,361, to Morita. Disclosed therein is a magnetic clasp that protects magnetic records from being adversely affected by the magnetic induction lines of a magnet. The disclosed clasp is characterized in that the lines of magnetic induction inherent to the magnet thereof are conveyed by the ferromagnetic end surface rather than diverged to outside, in order to maximize the attracting power of the magnet. The disclosed magnetic clasp may be used as a clasp or lock for bags, boxes, bands or similar items.

U.S. Pat. No. Des. 274,467, and U.S. Pat. No. Des. 274,468, each to Morita, each disclose the ornamental design for a separable magnetic lock for a purse or similar article. U.S. Pat. No. Des. 274,883, to Aoki discloses the ornamental design for a separable magnetic lock for a purse or similar article.

Although the devices disclosed in the above enumerated prior art references have improved features, there still exists a need for an improved magnetic closure device for personal effect carriers such as purses, pouches, day packs, and backpacks, and which includes means for allowing facile interconnection of interlocking portions thereof

OBJECTS OF THE INVENTION

It is therefore an object of the present invention to provide an improved magnetic closure device;

It is another object of the present invention to provide a magnetic closure device for personal effect carriers such as purses, pouches, day packs, and backpacks;

It is a further object of the present invention to provide an improved magnetic closure device for personal effect carriers such as purses, pouches, day packs, and backpacks that includes means for allowing facile location and interlocking of the portions thereof;

It is still another object of the present invention to provide an improved magnetic closure device for personal effect carriers such as purses, pouches, day packs, and backpacks that includes means for protecting magnetically susceptible objects stowed in a compartment of the carrier from being adversely affected by the magnetic field radiated by the magnet; and It is yet a further object of the present invention to provide an improved magnetic closure device for personal effect carriers such as purses, pouches, day packs, and backpacks that is aesthetically pleasing.

SUMMARY OF THE INVENTION

These and other objects and advantages of the present invention are achieved by providing an improved magnetic closure device for personal effect carriers such as purses, pouches, day packs, and backpacks among others. In the preferred embodiment, the present invention comprises a flap assembly affixed to a cover or flap of the carrier, and a receiving assembly, that is affixed to the sidewall of the carrier, preferably adjacent to a desired compartment to be enclosed. The cover and sidewall assemblies are formed complementary to one another and may be configured into any one of several aesthetically pleasing shapes, particularly when the device of the present invention is embodied in a purse or backpack.

In the preferred embodiment, the flap assembly is affixed to the cover or flap of a flexible personal effect carrier, such as a purse The flap assembly is preferably configured with a generally annular, but may comprise any other appropriate configuration. The flap assembly comprises an inner plate affixed to an inner surface of the flap, and a cover plate affixed to an outer surface of the flap. The inner plate and cover plate are each configured with an annular aperture and an annular opening is formed through the flap, such that an annular receiving orifice is formed through the entire flap assembly.

The receiving assembly is affixed to the sidewall of the purse and is provided with a configuration that is complementary to the configuration of the flap assembly to facilitate interlocking of the two assemblies. In the preferred embodiment of the present invention, the receiving assembly is provided with a cylindrical projecting member that projects outwardly from the outer surface of the carrier's sidewall. The projecting member is configured to extend through the receiving orifice in the flap assembly, without projecting substantially beyond the cover plate of the flap assembly, when the flap is in a closed position. The annular cross-sectional configuration of the projecting member is complementary to the cross-sectional configuration of the flap assembly's annular orifice, so that the projecting member slip-fits the orifice.

Additionally, the projecting member is configured with a convex end. The curvature of the convex end aids a user with guiding the flap assembly's orifice over the projecting member for interlocking the flap assembly and receiving assembly. Thus, the projecting member and orifice coact as a guide means to enable a user to quickly and easily locate the receiving assembly on the purse's sidewall for providing facile attaching and detaching of the flap to the sidewall of the purse. The configuration of the projecting member enhances the ease with which the flap assembly is aligned with the receiving assembly, for coupling the flap assembly to the receiving assembly when securing the flap to the purse. Further, when the projecting member is disposed through the orifice, the projecting member appears to the user as an integral component of the flap assembly to enhance the aesthetics of the invented closure device.

In the preferred embodiment of the present invention, a magnet is provided for positively securing the flap assembly to the receiving assembly, to inhibit the closure device of the present invention from inadvertently releasing, which could allow the flap to detach from the sidewall. The magnet is mounted in one of the assemblies and a magnetically attracted component is mounted opposite to the magnetic. Preferably, the magnet is positioned in the receiving assembly and beneath the projecting member. The magnet may have an annular configuration and slighter greater diameter that the diameter of the projecting member. The magnet comprises a suitable ferromagnetic metal alloy and is configured for radiating a magnetic field of sufficient force to couple the flap assembly to the receiving assembly.

Similarly, the magnetically attracted component may comprise an integral component of the flap assembly. In the preferred embodiment, both the inner plate and cover plate comprise a ferromagnetic metal alloy that is attracted to the magnet. When the projecting member is disposed through the flap assembly's orifice, the magnetic force radiated by the magnet draws the flap assembly against the receiving assembly, to magnetically couple the two assemblies, for detachably and securely coupling the flap assembly to the receiving assembly, and thus securing the flap to the purse.

Additionally, components of the flap and receiving assembly of the magnetic closure device of the present invention interlock to inhibit the magnetic field radiated by the magnet from radiating extraneously inside of the invented magnetic closure device and to prevent magnetic field radiated by the magnet from radiating into a compartment of the carrier and potentially destroying information stored on magnetic data storage media, such as credit cards and computer diskettes.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIGS. 3A and 3B show the flap assembly and receiving assembly of the preferred embodiment of the magnetic closure device for personal effect carriers of the present invention interlocking;

DESCRIPTION OF THE PREFERRED EMBODIMENTS

The following description is provided to enable any person skilled in the art to make and use the invention and sets forth the best modes presently contemplated by the inventor of carrying out his invention. Various modifications, however, will remain readily apparent to those skilled in the art, since the generic principles of the present invention have been defined herein.

Figure 4:
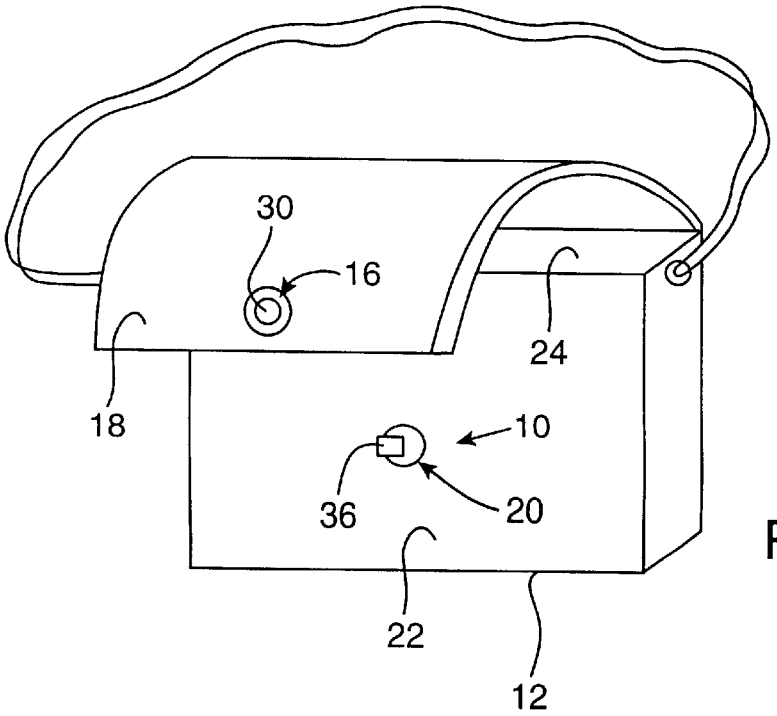
FIG. 4 is a perspective view of a purse embodying the improved magnetic closure device of the present invention.
Figure 5:
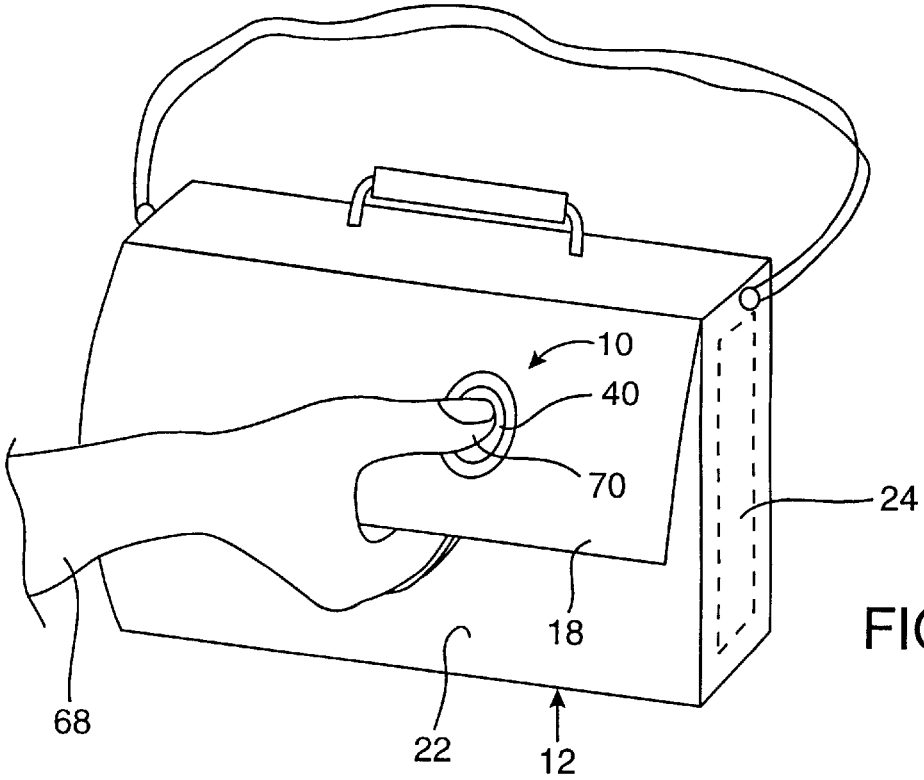
FIG. 5 is another perspective view of the purse embodying the improved magnetic closure device of the present invention.

Referring now to the drawing Figures, there is shown generally at 10, a preferred embodiment of an improved magnetic closure device for personal effect carriers constructed according to the principles of the present invention. The magnetic closure device 10 of the present invention is well suited for a number of different personal effect carriers, including flexible carriers such as pouches, day packs and backpacks, and purses 12 among others. In the preferred embodiment, the present invention 10 comprises a flap assembly shown generally at 16 (FIGS. 1A and 1B), affixed to a cover or flap 18 of the carrier, and a receiving assembly shown generally at 20 (FIGS. 2A and 2B), that is affixed to a sidewall 22 of the carrier. A desired carrier, such as the purse 12, and thus the flap 18 and sidewall 22 (FIGS. 4 and 5), thereof, may comprise any one of several well known pliable materials, that most preferably is somewhat supple. For example, the carrier may comprise soft leather, known polymeric materials, and several other well known materials and textiles. Alternatively, the carrier may comprise a personal effect carrier having rigid sidewalls, such an attaches case, for example.

The flap and receiving, assemblies 16, 20 are formed complementary to one another so that the present invention is well suited for coupling adjacent portions of several different types of personal effect carriers together. Portions of the flap and receiving assemblies 16, 20 may be configured into any one of several different desired shapes so that the assemblies 16, 20 are aesthetically pleasing, particularly when the magnetic closure device 10 of the present invention is embodied in a carrier, such as the purse 12. It is to be understood that the configuration of the flap assembly 16 and receiving assembly 20 may be readily altered, so that the receiving assembly 20 can be coupled to the flap 18 and the flap assembly 16 can be affixed to the sidewall 22 of the carrier, if desired.

Figure 1A:
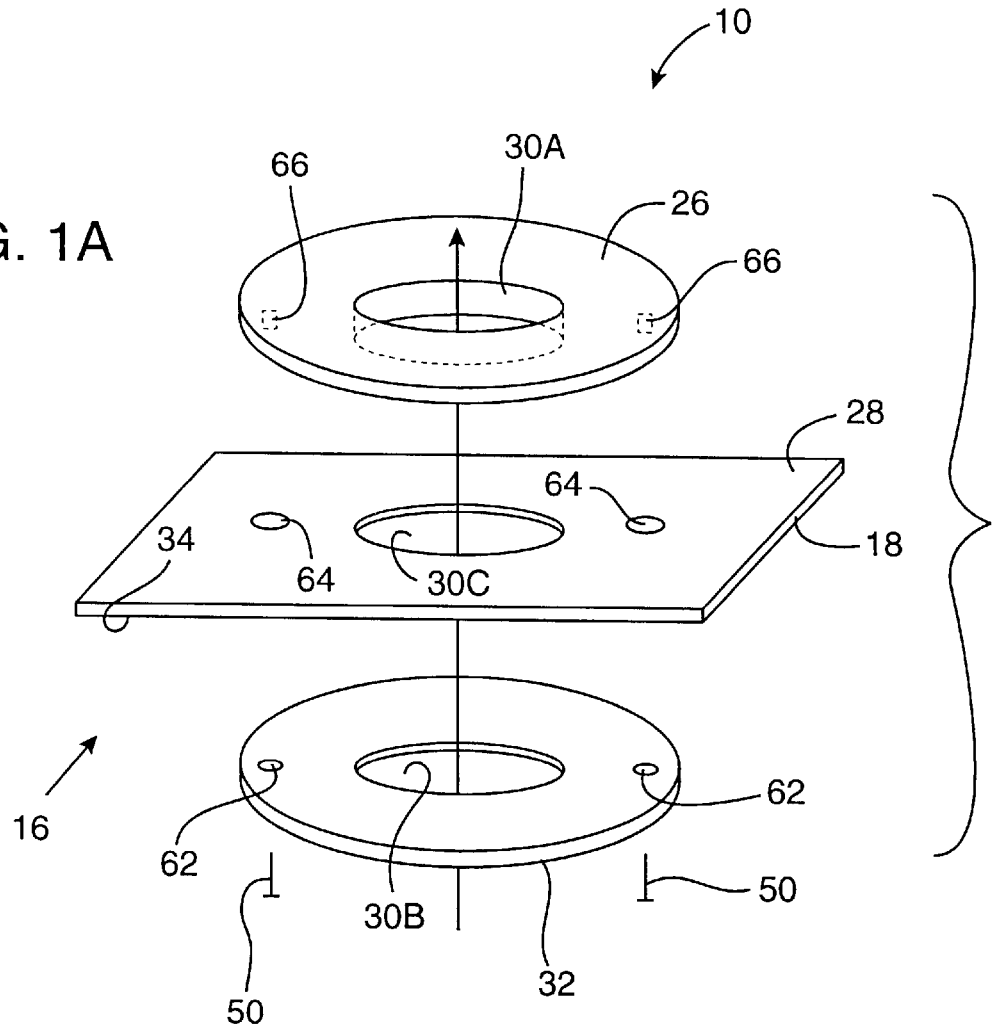
FIG. 1A is an exploded view showing a flap assembly of a preferred embodiment of an improved magnetic closure device for personal effect carriers of the present invention.
Figure 1B:
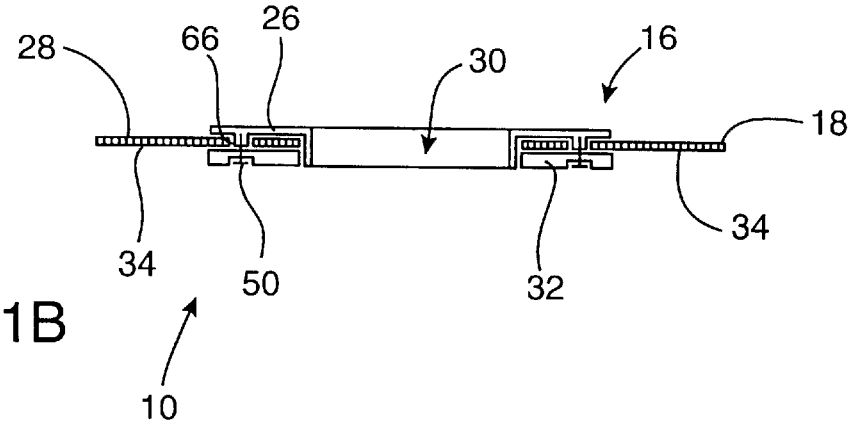
FIG. 1B is a fragmentary, cross-sectional view of the flap assembly of the present invention.

Referring particularly to FIGS. 1A and 1B of the drawings, in the preferred embodiment 10, the flap assembly 16 is affixed to the flap 18 of a flexible personal effect carrier, such as the purse 12. The flap assembly 16 comprises an outer cover plate 26 adapted to be affixed to an outer surface 28 of the flap 18. The cover plate 26 may be configured into an aesthetically pleasing shape, which may be oval, teardrop, or substantially rectangular. Preferably, the cover plate 26 has a substantially annular configuration with an annular aperture 30A is disposed through its center. The cover plate 26 preferably comprises any one of several well known ferromagnetic metal alloys and is approximately 1 mm (millimeters) thick.

An inner plate 32 is adapted to be affixed to an inner surface 34 of the flap 18. While the inner plate 32 may have any desired configuration suitable for mating with the flap 18 and cover plate 26, preferably the inner plate 32 has an annular configuration complementary to the configuration of the cover plate 26 and is similarly dimensioned. Additionally, the inner plate 32 may be fabricated from a known ferromagnetic metal alloy and is approximately 1.2 mm in thickness. An annular aperture 30B that is dimensioned analogous to the cover plate's annular aperture 30B is formed through a center of the inner plate 32.

The flap 18 of the carrier 12 has an annular opening 30C formed therethrough. The opening 30C is dimensioned analogous to the apertures 30A, 30B formed in the outer and inner plates 26, 32.

Figure 2A:
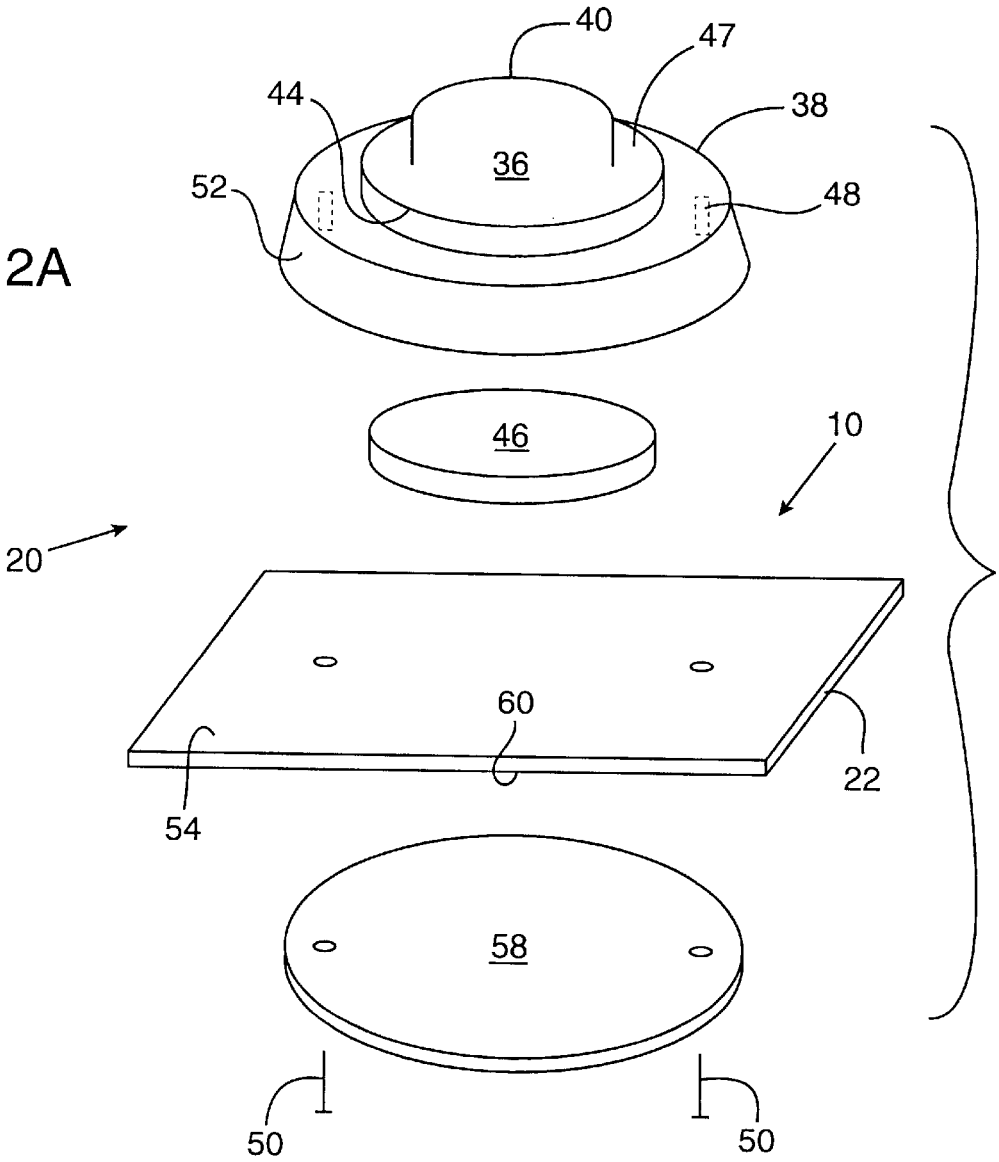
FIG. 2A is an exploded perspective view showing a receiving assembly of the present invention.
Figure 2B:
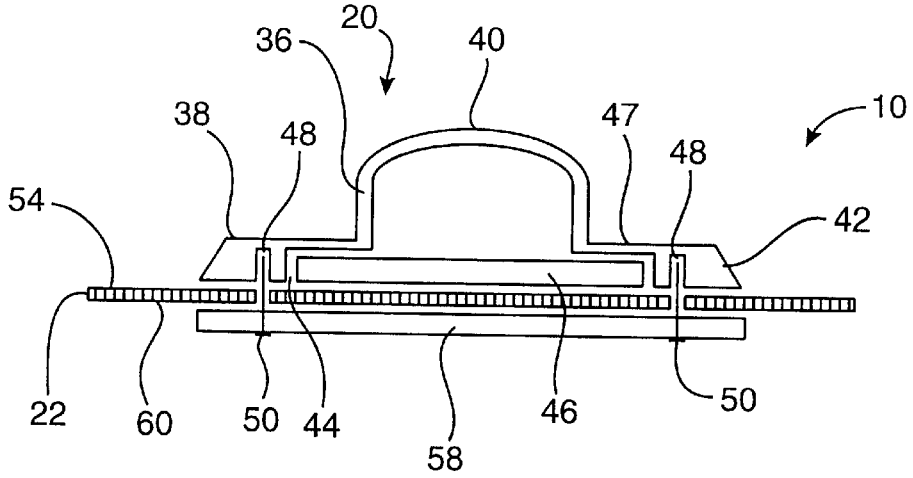
FIG. 2B is a fragmentary, cross-sectional view of the receiving assembly of the present invention.

Referring now to FIGS. 2A and 2B, the receiving assembly 20 is affixed to the sidewall 22 of the selected carrier 12, 14. The assembly 20 includes a projecting member 36 coupled to a base platform 38. The projecting member 36 is preferably integrally formed with the base platform 38 or may be affixed to the base platform 38 using known means, such as welding for example. The projecting member 36 is preferably hollow with a cylindrical cross-sectional configuration and is configured with a convex end 40. The curvature of the convex end 40 aids a user with guiding a receiving orifice 30 (to be discussed hereinafter) of the flap assembly 16 over the projecting member 36, for interlocking the flap assembly 16 and receiving assembly 20. The projecting member 36 and base platform 38 preferably comprise a well known antiferromagnetic metal alloy, such as aluminum In the preferred embodiment of the present invention, the projecting member 36 is configured to extend through a receiving orifice 30 (to be discussed hereinafter) of the flap assembly 16. The projecting member 36 is preferably dimensioned to have a height that enables the convex end 40 of the member 36 to extend entirely through the assembly 16, without projecting substantially beyond the cover plate 26 thereof. This enables the projecting member's end 40 to appear as an integral component of the flap assembly 16, when the flap 18 is in a closed position and the flap assembly 16 and receiving assembly 20 are interlocked (shown in FIG. 3B). Also this enables a user 68 to easily detach the flap assembly 16 from the receiving assembly 20.

The base platform 38 has an annular cross-section that is analogous to the cross-sectional configuration of the cover plate 26. A wall 42 extends downwardly about the periphery of the base platform 38 for forming, an annular cavity 44. The wall 42 is substantially thick for inhibiting magnetic field radiated by a magnetic field means 46 retained in the cavity 44. The base platform is 38 is further provided with a substantially thin, approximately 0.5 mm, top wall 47. The top wall 47 is sufficiently to allow the magnetic field radiated by the magnetic field radiating means 46 to pass therethrough and to the inner plate 32 affixed to the flap 18. A pair of diametrically opposed holes 48 are formed in the wall 42 The holes are configured to receive affixing members 50 used for coupling the receiving, assembly 20 to the sidewall 22 of the carrier.

The magnetic field radiating means 46 preferably comprises a disk shaped magnet 46 comprising a known ferromagnetic metal alloy. The magnet 46 is configured to be retained in the cavity 44 and to be interposed between a bottom edge 52 of the wall 42 and an outer surface 54 of the sidewall 22. The disk shaped magnet 46 is configured with a width that is substantially equal to the height of the cavity 44. In the preferred embodiment, the magnet 46 is approximately 3 mm thick. When the platform 38 is affixed to the sidewall 22, the wall's bottom edge 52 abuts the magnet 46, such that the magnet 46 is retained tightly between the platform 38 and sidewall 22, for inhibiting relative movement of the magnet 46.

A disk shaped retaining plate 58, that preferably comprises ferromagnetic metal, is adapted to be affixed to an inner surface 60 of the sidewall 22 and coupled to the base platform 38. Preferably, the retaining plate 58 has a cross-sectional configuration that is substantially similar to the cross-sectional configuration of the platform 38 and is about 1.5 mm thick. The configuration of the retaining plate 58 aids with supporting the receiving assembly 20 on the sidewall 22 of the carrier 12. Further, the platform 38, sidewall 22, and retaining plate 58 coact to substantially prevent any magnetic field radiated by the disk shaped magnet 46 from substantially radiating inwardly into the carrier 12.

Referring again to FIG. 1A and FIG. 1B of the drawings, the flap assembly 16 is affixed to the flap 18 using known affixing means. For instance, affixing members 50, which may comprise screws, rivets, or other known fasteners, are disposed through a first set of diametrically opposed holes 62 formed in the inner plate 32. The affixing members 50 are then disposed through a second set of diametrically opposed holes 64 formed in the flap 18, and finally coupled to downwardly projecting receiving means 66 integrally formed with the cover plate 26.

The flap assembly 16 is affixed to the flap 18 by first disposing an affixing member 50 through each hole 62 in the inner plate 32. The members 50 are then disposed through the holes 64 formed in the flap 18, and the inner plate 32 is brought against the inner surface 34 of the flap 18. Since the holes 64 in the flap 18 are aligned with the holes 62 formed through the inner plate 32, the inner plate's aperture 30B is aligned with the flap's opening 30C.

Once the inner plate 32 is positioned against the inner surface 34 of the flap 18, the cover plate 26 is positioned about the flap's opening 30C, such that the cover plate's aperture 30A is aligned with the opening, 30C. The affixing members 50 are then coupled to the receiving means 66 using any appropriate method, depending upon the type of fastener comprising the affixing members 50. The members 50 are coupled to the receiving means 66 until the inner plate 32 and cover plate 26 are brought tightly against the outer and inner surfaces 28, 34 of the flap 18, to prevent relative movement between the plates 26, 32 and flap 18, for affixing the flap assembly 16 to the flap 18. The apertures 30A, 30B in the plates 26, 32 and the opening 30C in the flap 18 are aligned to form a flap assembly receiving orifice 30 (shown in FIG. 1B) that extends entirely through the flap assembly 16.

Referring to the drawing Figures, and particularly to FIGS. 3A and 3B, in the preferred embodiment 10 of the present invention, the flap assembly 16 and receiving assembly 20 are interlocked by a user 68 first grasping the flap 18 of the carrier 12. Preferably, the user 68 grasps the flap assembly 16, or the flap 18 at a location proximal to the assembly 16. The user 68 then rotates, or moves the flap 18, toward the sidewall 22 of the carrier 12. As the flap 18 is rotated toward the sidewall 22, the flap's inner surface 34 first contacts the convex end 40 of the projecting member 36. The user 68 feels the projecting member's end 40 contact the flap 18, since the convex end 40 causes the flap 18 deform slightly. The curvature of the convex end 40 aids the user 68 with guiding the flap assembly's receiving orifice 30 over the projecting member 36 to help with interlocking the assemblies 16, 20. The user 68 repositions the flap 18 until they feel the end 40 of the projecting member 36 contact the flap assembly's inner plate 32.

Once the user 68 feels the projecting member's end 40 contact the inner plate 32, they can easily adjust the flap 18 alone the member's end 40 until the receiving orifice 30 is positioned over the projecting member's end 40. The flap assembly 16, and therefore the flap 18, is then slid along the length of the member 36 until the inner plate 32 contacts the platform 38 of the receiving assembly 20. When the flap 18, and thus the flap assembly's inner plate 32 is positioned near the base platform 38, and thus the receiving, assembly 20, the magnetic force radiated by the magnet 46 draws the inner plate 32 of the flap assembly 16 tightly against the platform 38 to magnetically couple the two assemblies 16, 20 for securing the flap 18 to the sidewall 22. The magnetic field radiated by the magnet 46 causes the inner plate 32 to detachably, magnetically couple to the platform 38, due to the magnetic force that the magnet 46 exerts on the magnetically attracted inner plate 32.

Therefore, the flap assembly 16 is detachably and securely coupled to the receiving assembly 20 without additional fastening means, such as turn-locks and turnbuckles, clamps, buckles, snap fasteners, and the like. The projecting member 36 and receiving orifice 30 coact to enable the user 68 to interlock the invented closure device 10 by feeling alone, without having to visually inspect either the carrier 12, or closure device 10, or both. Thus, the flap 18 is securely coupled to the sidewall 22 of the carrier 12 to prevent objects stowed in the compartment 24 of the carrier 12 from being inadvertently dislodged therefrom.

The user 68 can easily detach the flap assembly 16 from the receiving assembly 20 by first grasping the flap 18 proximal to the flap assembly 16. The user 68 then can place one of their digits, such as their thumb 70, over the end 40 of the projecting member 36. While pressing against the projecting member's end 40, with their thumb 70, the user 68 can pull the flap 18 away from the sidewall 22 of the purse 12. This causes the flap assembly's inner plate 32 to be moved away from the platform 38 until the magnetic force that the magnet 46 exerts on the inner plate 32 is no longer sufficient to couple the inner plate 32 to the platform 38, thus detaching the flap assembly 16 from the receiving assembly 20.

The ferromagnetic metal alloy comprising the retaining plate 58 inhibits the magnetic field radiated by the magnet 46 from coming into the compartment 24 of the carrier 12 proximal to the invented magnetic closure device 10. Thus, the present invention 10 is configured to inhibit the magnetic field radiated thereby, from potentially destroying information stored on magnetic data storage media, such as credit cards, computer diskettes, or other magnetically susceptible objects that may be stowed in the carrier 12.

Thus, there has been described an improved magnetic closure device for personal effect carriers. The invented closure device comprises a flap assembly affixed to the flap of the carrier and a receiving assembly affixed to its sidewall. The assemblies are formed complementary to one another and are preferably configured into any one of several aesthetically pleasing shapes. The projecting member has a convex end for causing the flap to deform slightly when the projecting member contacts the flap, so that the user can feel the member and can reposition the flap assembly toward the projecting member. Once the user feels the projecting member's end contact the inner plate, they can easily adjust the flap alone the member's end until the receiving orifice is positioned over the projecting member's end. Thus, the projecting member and receiving orifice coact as a guide to enable a user to easily locate the receiving assembly for quickly interconnecting the two assemblies. The present invention is configured to inhibit the magnetic radiated thereby from potentially destroying information stored on magnetic data storage media, such as credit cards, computer diskettes, or other magnetically susceptible objects that may be stowed in the carrier.

Those skilled in the art will appreciate that various adaptations and modifications of the just-described preferred cilnbocilments can be configured without departing from the scope and spirit of the invention. Therefore, it is to be understood that, within the scope of the appended claims, the invention may be practiced other than as specifically described herein.

What is claimed is:

1. A magnetic closure device for a personal effect carrier, the closure device comprising:

a flap assembly coupled to a flap of the personal effect carrier, the flap assembly including, an annular cover plate secured to an outer surface of the flap, the cover plate having an annular aperture formed therethrough, an annular inner plate secured to an inner surface of the flap, the inner plate positioned on the inner surface of the flap such that an annular aperture formed therethrough is substantially aligned with the aperture formed in the cover plate, the cover plate and inner plate comprising a ferromagnetic metal alloy, and the flap having an annular opening formed therethrough, the inner and cover plates secured to the flap such that the apertures in the plates are aligned with the opening in the flap to form an annular receiving orifice that extends through the flap assembly; and a receiving assembly coupled to a sidewall of the personal effect carrier for receiving the flap assembly, the receiving assembly including, a cylindrical projecting member extending outwardly from the sidewall of the carrier, the projecting member adapted to extend through the receiving orifice to aid with coupling the flap assembly to the receiving assembly, the projecting member configured to appear as an integral component of the flap assembly when the flap assembly is coupled to the receiving assembly, the projecting member having a convex end so that the curvature of the end aids a user with guiding the receiving orifice about the projecting member for interlocking the flap assembly radiating and receiving assembly, an annular base platform integrally formed with the projecting member, the base platform having annular cross-sectional dimension that is analogous to the cross-sectional dimension of the cover plate, the platform having a wall extending downwardly about the periphery thereof for forming an annular cavity and a substantially thin top wall, magnetic field radiating means retained in the cavity, the magnetic field radiating a magnetic field of sufficient strength to magnetically couple the magnetically attracted inner plate thereto for magnetically detachably coupling the receiving assembly and flap assembly, a width of the magnetic field radiating means dimensioned similarly to a height of the cavity, such that when the platform is coupled to an outer surface of the sidewall, the magnetic field radiating means contacts the sidewall to limit relative movement therebetween, the top wall of the base platform substantially thin for limiting the amount of the magnetic field radiated by the magnetic field radiating means that passes through the base platform and to the inner plate, and an annular retaining plate comprising a magnetically attracted ferromagnetic metal alloy coupled to an inner surface of the sidewall to aid the base platform and sidewall with supporting the projecting member, the retaining plate and sidewall of the carrier coacting to inhibit the magnetic field radiated by the magnetic field radiating means from penetrating the sidewall of the carrier and from potentially destroying information stored on magnetic data storage media stowed in the carrier, the retaining plate having a cross-sectional dimension similar to the cross-sectional dimension of the base platform, wherein as the flap is positioned toward the sidewall of the carrier, the inner surface of the flap contacts the convex end of the projecting member causing a slight deformation of the flap to indicate to a user the location of the receiving assembly, the user then repositioning the flap along the sidewall of the carrier until the flap assembly is located adjacent to the receiving assembly, the flap repositioned until the end of the projecting member is aligned with the receiving orifice, the flap assembly then slid along the projecting member until the inner plate contacts the platform, the radiating means drawing the inner plate against the platform, due to the magnetic force that the magnetic field radiating means exerts on the inner plate, to magnetically detachably couple the inner plate to the platform for magnetically detachably coupling the receiving assembly to the flap assembly.

2. The closure device of claim 1 wherein the retaining plate is configured similarly to the base platform to aid the retaining plate and sidewall with supporting the projecting member.

3. The closure device of claim 1 wherein both of the cover plate and inner plate comprise a magnetically attracted ferromagnetic metal alloy.

4. The closure device of claim 1 wherein the magnetic field radiating means has a diameter greater than the diameter of the projecting member.

5. The closure device of claim 4 wherein the magnetic field radiating means has a diameter greater than the diameter of the projecting member to enable the magnetic field radiating means to radiate a magnetic field of sufficient force to magnetically detachably couple the receiving assembly to the flap assembly.

6. The closure device of claim 1 wherein the annular aperture formed in the inner plate and the projecting member arc each configured with an aesthetically pleasing annular configuration so that the projecting member appears as an integral component of the flap assembly, when the flap assembly is coupled to the receiving assembly.

7. The closure device of claim 6 wherein the end of the projecting member extends slightly beyond an outer side of the cover plate when the flap assembly is coupled to the receiving assembly so that the projecting member appears as an integral component of the flap assembly and to aid a user with locating the projecting member for detaching the flap assembly from the receiving assembly.

8. The closure device of claim 1 wherein the base platform comprises an antiferromagnetic metal alloy and the top wall thereof is sufficiently to allow the magnetic field radiated by the magnetic field radiating means to pass therethrough.

* * * * *